US006820286B2

(12) United States Patent
Paul et al.

(10) Patent No.: US 6,820,286 B2
(45) Date of Patent: Nov. 23, 2004

(54) PROTECTIVE MASK

(76) Inventors: Barry Rene Paul, 20 Old Church Lane, Kingsbury, London (GB), NW9 8TD; Lance Gordon Rake, 917 Illinois St., Lawrence, KS (US) 66044

( * ) Notice: Subject to any disclaimer, the term of this patent is extended or adjusted under 35 U.S.C. 154(b) by 0 days.

(21) Appl. No.: 10/267,579

(22) Filed: Oct. 10, 2002

(65) Prior Publication Data

US 2003/0070202 A1 Apr. 17, 2003

(51) Int. Cl.[7] ..... A63B 71/10
(52) U.S. Cl. ..... 2/425; 2/9; 2/424
(58) Field of Search ..... 2/9, 15, 410, 411, 2/417, 424, 425, 452

(56) References Cited

U.S. PATENT DOCUMENTS

| | | | | | |
|---|---|---|---|---|---|
| 1,196,411 | A | * | 8/1916 | Welch | 2/9 |
| 1,203,564 | A | * | 11/1916 | April | 2/9 |
| 1,395,761 | A | * | 11/1921 | Monro et al. | 128/207.11 |
| 1,942,442 | A | * | 1/1934 | Motsinger | 128/207.11 |
| 5,046,200 | A | * | 9/1991 | Feder | 2/452 |
| 5,481,763 | A | * | 1/1996 | Brostrom et al. | 2/452 |
| 5,953,761 | A | * | 9/1999 | Jurga et al. | 2/425 |
| 6,189,156 | B1 | * | 2/2001 | Loiars | 2/424 |

FOREIGN PATENT DOCUMENTS

| | | | | |
|---|---|---|---|---|
| EP | 0 943 361 | * | 9/1999 | A63B/71/10 |
| FR | 2595949 | * | 9/1987 | A63B/71/10 |
| FR | 2595950 | * | 9/1987 | A63B/71/10 |
| FR | 2596285 | * | 10/1987 | A63B/71/10 |

* cited by examiner

*Primary Examiner*—Gary L. Welch
(74) *Attorney, Agent, or Firm*—Dennison, Schultz, Dougherty & MacDonald

(57) ABSTRACT

A mask for protecting the face and neck of a person while fencing comprises a mask body including a face piece 10 for protecting the face of the wearer, a neck covering member 15 for protecting the neck of a wearer and retaining means comprising a first strap 20 extending rearwardly and downwardly from an upper portion of the mask body, a second 21 member extending rearwardly from a first side of the mask body, a third strap 22 extending rearwardly from a second side of the mask body opposite said first side, a connecting member 23 being provided at the intersection of the first, second and third strap or harness members, each of said first, second and third strap or harness members being connected to said connecting member 23, the connecting member 23 comprising a dished plate-like member having first, second and third apertures therein, through which apertures are respectively received a respective end of the first, second and third straps.

13 Claims, 4 Drawing Sheets

PROTECTIVE MASK

The present invention relates to an improved protective mask, and in particular a fencing mask for protecting the head and neck of a wearer while fencing using epee, foil or sabres, although it could also be used to protect the head and neck of the wearer during other contact sports such as Kendo.

As shown in FIG. 1, a known fencing mask comprises a steel mesh face piece 1 for covering the face of a wearer, a further mesh top panel 2 extending over the top of the wearer's head and down either side thereof to cover the wearer's ears and a thick fabric neck covering member, usually known as a bib 3. An elastomeric band 4 connects the face piece 1, top panel 2 and bib 3 together. The mask is held to the wearer's head by means of a bendable tab 5 extending over the top of the wearer's head and an elastic head band 6 extending around the rear of the wearer's head. Rivets 7 are used to reinforce the attachment of the bib 3 to the top panel 2.

The bendable tab 5 must be bent to suit the wearer's head and unless this is done correctly the mask will not be fit correctly and may move around during use. A certain amount of skill is needed to bend the tab correctly to provide the required fit. Furthermore, if the mask is worn by more than one person the tab 5 will require bending to fit the users head each time the mask is worn, weakening the tab 5. Even where the tab 5 has been bent correctly to fit the wearer's head, such may not adequately hold the mask onto the wearer's head during fencing. Usually the tab 5, when bent, forms a right angle or L shape rather than producing the curve of the head.

According to the present invention there is provided a mask for protecting the face and neck of a person while fencing, the mask comprising a mask body, including a face piece for protecting the face of the wearer, retaining means for retaining the mask on the head of a wearer and a neck covering member for protecting the neck of a wearer, said retaining means comprising a first strap or harness member extending rearwardly and downwardly from an upper portion of the mask body, a second strap or harness member extending rearwardly from a first side of the mask body, a third strap or harness member extending rearwardly from a second side of the mask body opposite said first side, a connecting member being provided at the intersection of the first, second and third strap or harness members, each of said first, second and third strap or harness members being connected to said connecting member.

Preferably the first, second and third strap members are formed from an elastic material.

Preferably the connecting member comprises a substantially planar or dished plate-like member having first, second and third apertures therein, through which apertures are respectively received a respective end of the first, second and third strap members. Preferably said apertures comprise elongate slots.

Preferably the connecting member is shaped to conform to the approximate shape of the rear portion of the wearer's head whereupon the connecting member will rest during use of the mask.

Preferably a distal end of the first strap member passes through a respective aperture in the connecting member, said distal end being folded back to lie against a portion of the first strap member, securing means being provided on the first strap member to retain the distal end thereof against said portion of the first strap member.

The second and third strap members may comprise separate strap members and be secured to the connecting member in the same manner as the first strap member. However, in a preferred embodiment the second and third strap member comprise portions of a single strap member extending from said first side of said mask body to said second side of said mask body and passing through the second and third apertures in the connecting member. Each of the second and third strap members may comprise separate elongate members, a distal end of each passing through a respective aperture in the connecting member, and extending over said connecting member such that said distal ends overlap each other, securing means being provided on each of the second and third strap members to secure said distal ends of the respective strap member together while allowing the combined length of the second and third strap members to be adjusted.

Preferably the securing means of each strap member comprises a hook and loop fastening means, such as a VELCO ® hook and loop fastener. Advantageously an elasticated hook and loop fastening means may be provided. The effective length of the first strap member can thus be adjusted by passing more or less of the first strap member through the respective aperture in the connecting member, folding the distal end of the first strap member back against itself and securing said distal end to a portion of the first strap member. The combined length of the second and third strap members can be adjusted by simply separating the distal ends of the second and third strap member, passing more or less of the second and third strap members through the respective apertures in the connecting member and securing the distal ends of the second and third members together by means of the hook and loop fastening means provided thereon.

By forming each strap member from an elasticated loop pile fabric the distal end of one or more of the strap members, having a hook part of the hook and look fastening means stitched or otherwise secured thereto, can be attached to a portion of the same or a different strap member at any desired location.

The present invention will be described further, by way of example, with reference to the accompanying drawings, in which:—

Figure 1:
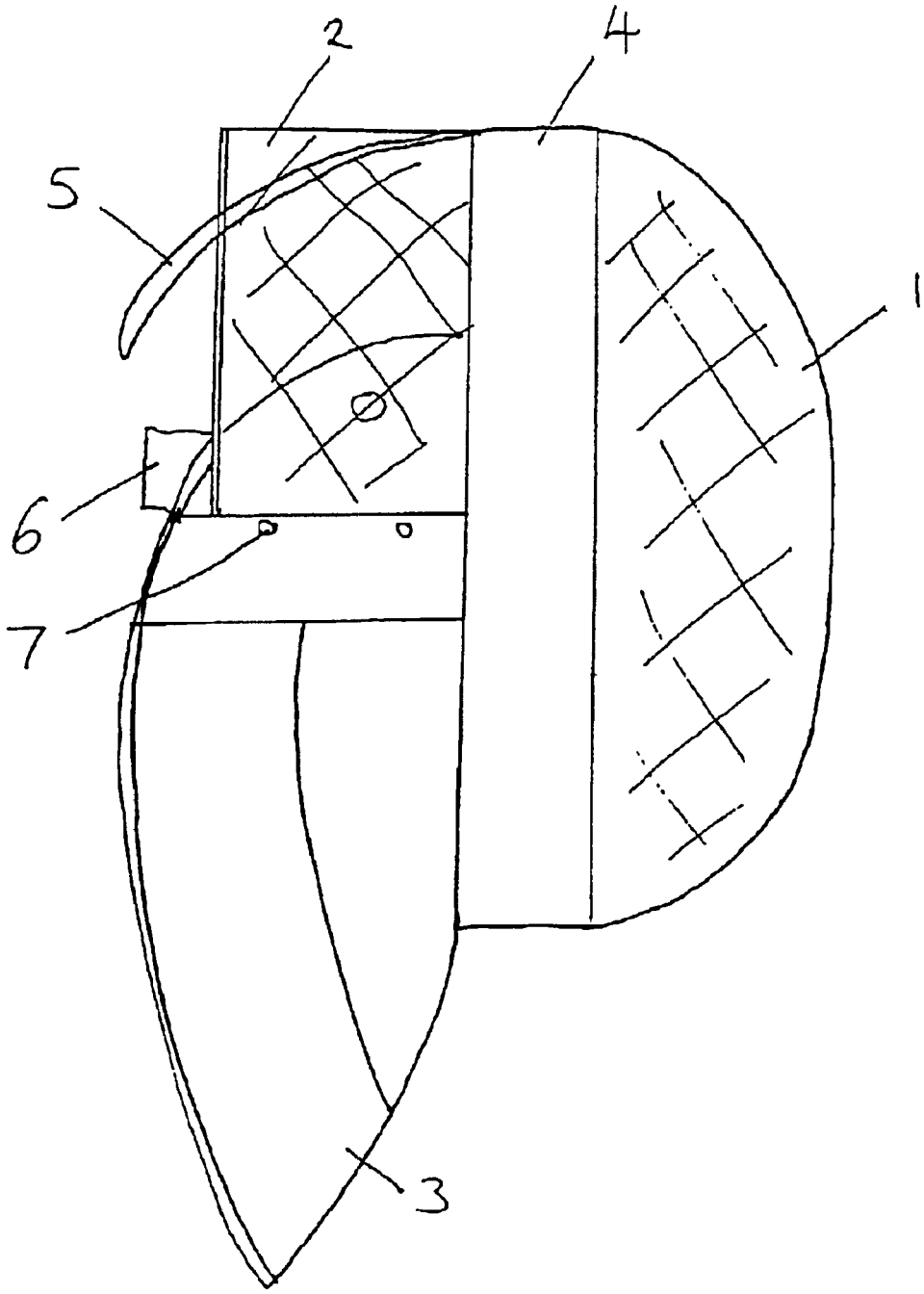
Fig. 1 PRIOR ART
FIG. 1 is a side elevation of an example of a prior art fencing mask.
Figure 2:
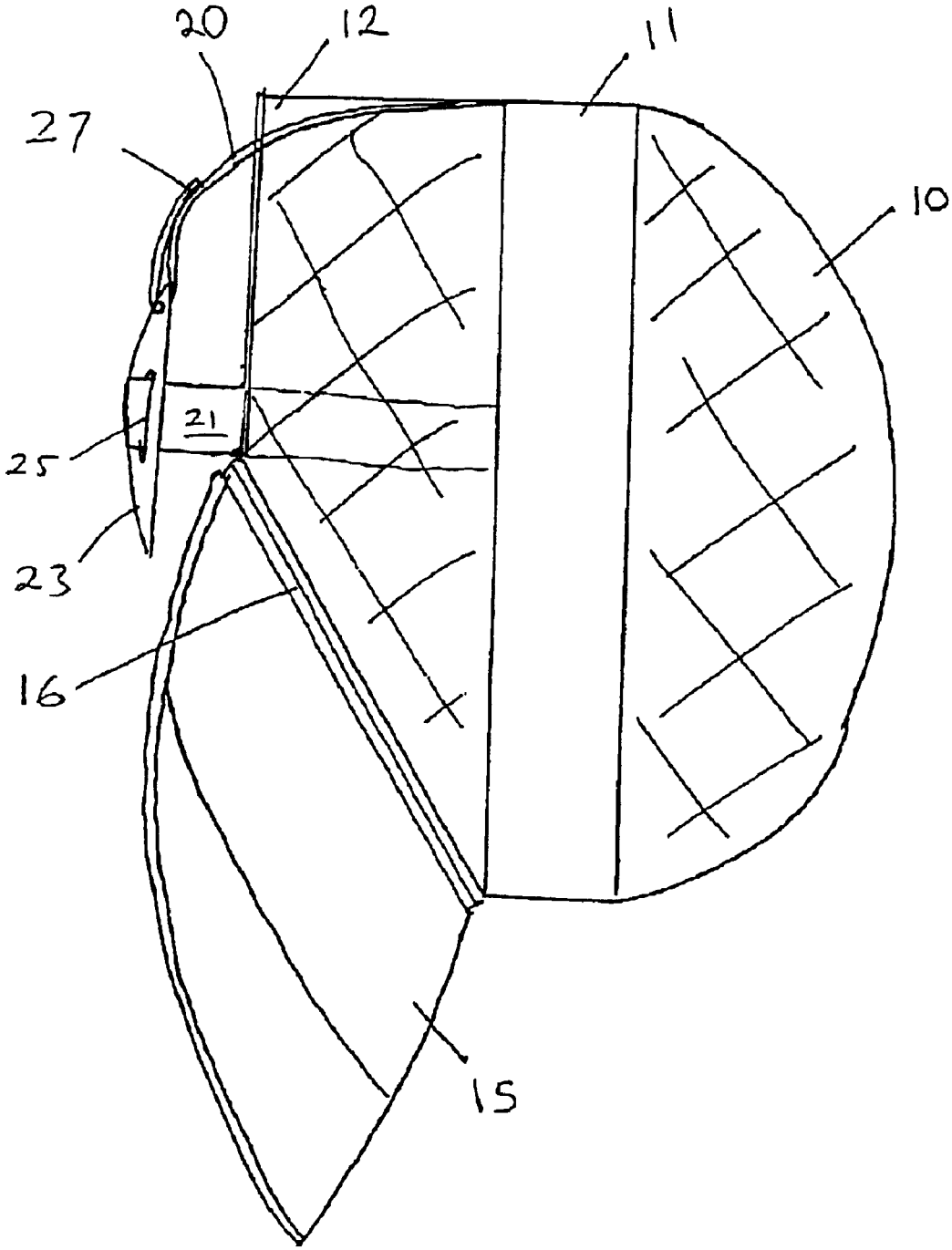
FIG. 2 is a side elevation of a fencing mask according to the invention.
Figure 3:
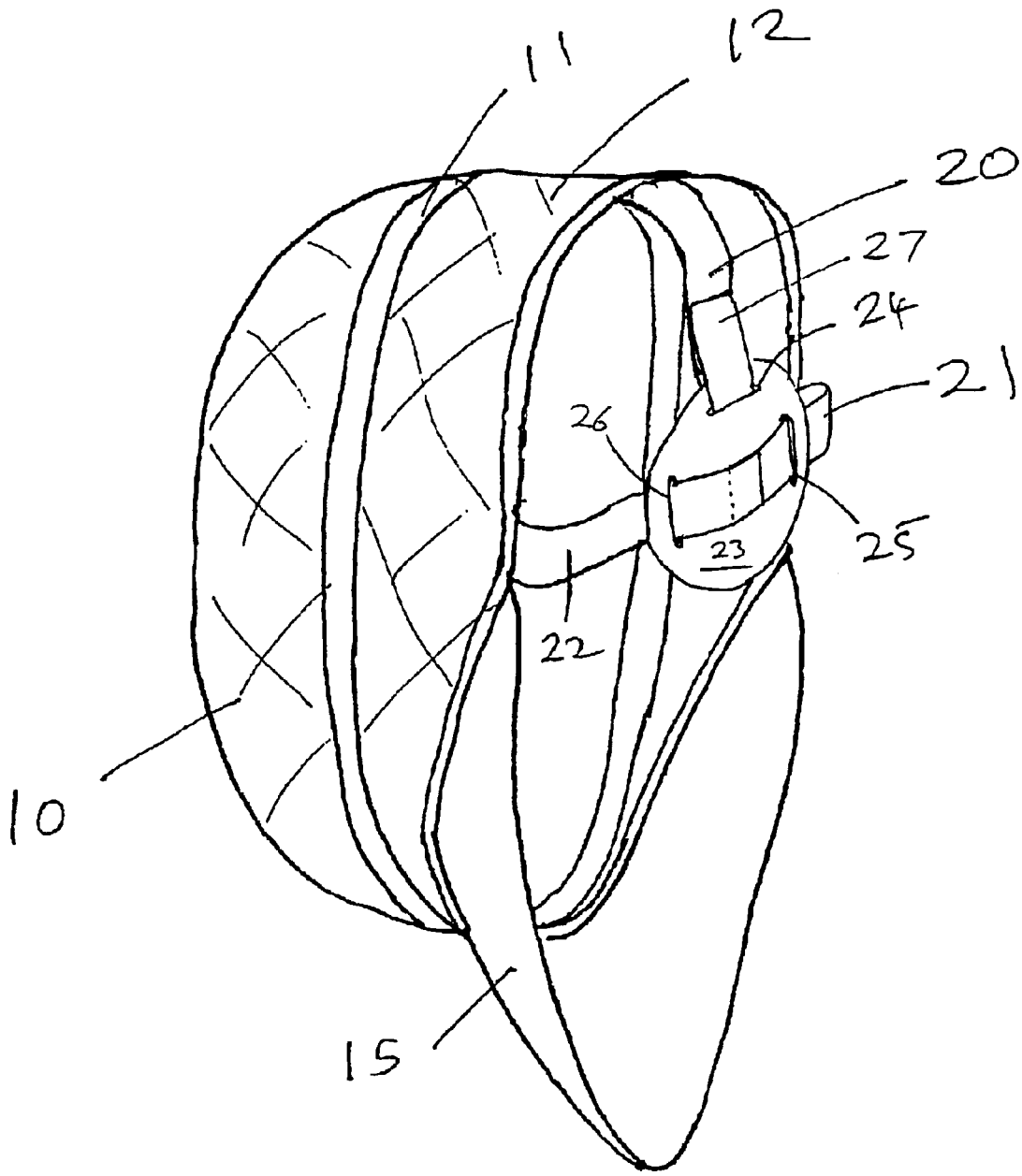
FIG. 3 is a perspective view of the mask of FIG. 2.

As shown in FIGS. 2 and 3, the fencing mask comprises a steel mesh face piece 10, for protecting the face of a wearer, connected by stitching to a front side of an elastomeric band 11. A further mesh panel 12, extending over the top and sides of the wearer's head and under the wearer's chin, is connected to the rear side of the band 11.

A fabric bib 15, for protecting the neck of the wearer, is detachably secured to the mesh panel 12 by means of an elongate channel member 16 connected to the lower edge of the mesh panel 12 and extending from one side of the mask to the other from positions adjacent the ears of the wearer and passing under the chin of the wearer when worn and a co-operating elongate bead provided on or adjacent the upper edge of the bib 15.

The mask shown in FIGS. 2 and 3, with the exception of the strap assembly, is subject of UK Patent Application GB 0109480.4, which describes the interface between the bib and the mask body in more detail.

Some modern fencing masks are now made from clear polymeric material, such as polycarbonate. Where a polycarbonate material is used for the face piece 10 and/or panel 12 (which may be formed integrally with each other) the channel member 16 may be moulded integrally with the face piece 10 or panel 12 or comprise a plastic material extrusion or moulding bonded thereto.

The strap assembly for retaining the mask on the wearer's head comprises an upper strap 20 having a first end connected by stitching and/or riveting or otherwise securing to an upper portion of the mask body and a second end passing through an elongate aperture 25 in a dish-shaped plastic connecting member 23. First and second side straps 21,22 have a respective first end secured by stitching and/or riveting or otherwise securing to respective sides of the mask body, respective second ends of the side strap 21,22 passing through respective elongate apertures 25,26 in the connecting member 23.

The upper strap 20, after being passed through the respective aperture 24 in the connecting member 23, is folded back upon itself and the second end thereof is secured to a portion of the strap 20 by means of a hook and loop fastening means 27. The upper strap 20 is formed from an elasticated loop pile fabric. A hook part of the hook and loop fastening means is secured to the second end of the upper strap 20 by means of stitching, adhesive or other fastening means such that, when the strap has been folded back on itself, the second end of the strap 20 can be secured to a portion of the strap at any desired location, allowing the upper strap 20 to be fixed at any desired length.

The second end of at least one of the second and third straps 21,22 has a hook part of a hook and loop fastening means secured thereto by means of stitching, adhesive or other fastening means and at least the other (preferably both) of the second and third straps 21,22 is formed from an elasticated loop pile fabric such that, once the second ends of the second and third straps have been passed through respective apertures 25,26 in the connecting member 23, said ends can be secured together in overlapping relationship by means of the hook and loop fastening means, as shown in FIG. 3.

The strap assembly according to the invention provides a comfortable and secure retaining means for the mask and allows the mask to be easily and repeatedly adjusted to suit the head size of the wearer.

Figure 4:
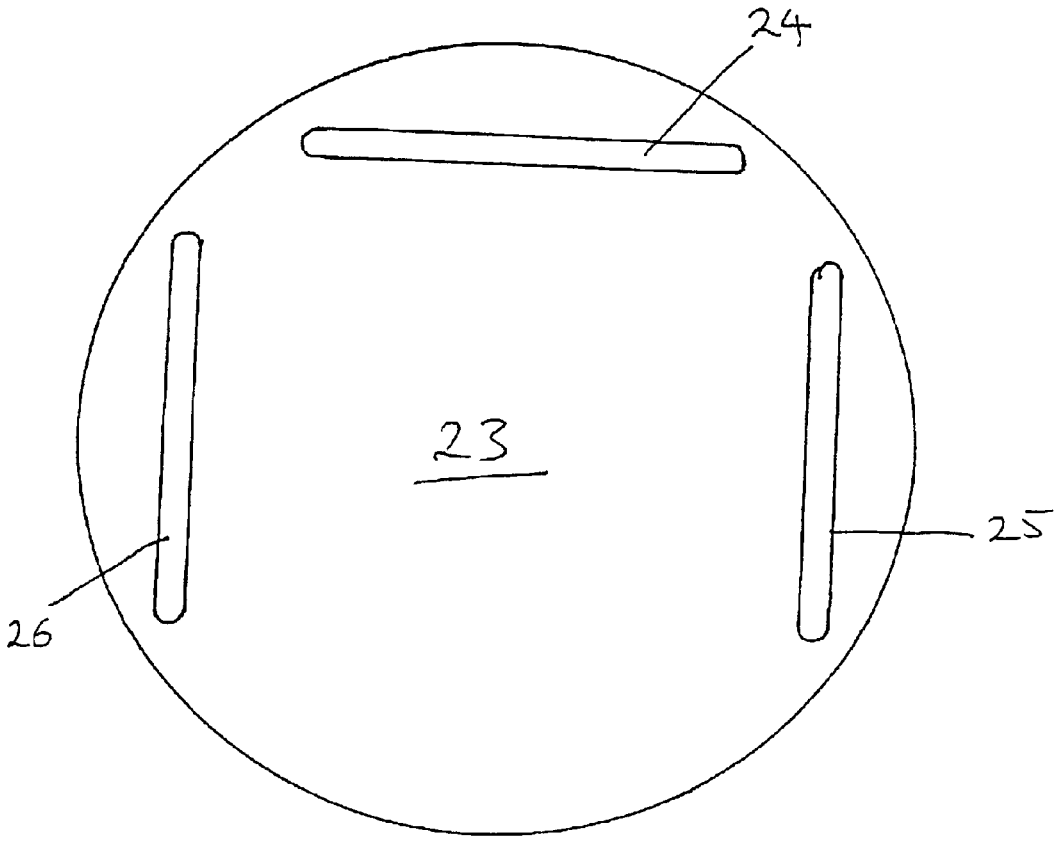
FIG. 4 is a front elevation of the connecting member of the mask of FIGS. 2 and 3.
Figure 5:
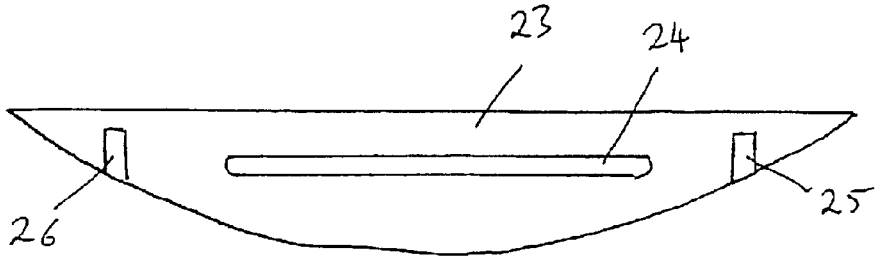
FIG. 5 is a plan view of the connecting member of FIG. 4

As shown in more detail in FIGS. 4 and 5, the connecting member 23 comprises a saucer or dish shaped circular member, the shape of the connecting member 23 being adapted to natural shape of the back of the wearer's head to provide a comfortable fit. The connecting member is relatively large compared to the width of the mask (for example for a mask width of 180 mm a connecting member of 110 mm can be used) such that the connecting member rests against and protects a considerable surface area of the rear of the wearer's head.

The connecting member may be molded from a suitable plastics material, such as ABS or polycarbonate. The manufacturers logo may be engraved or molded on the outer surface of the connecting member. While a circular member is shown in the preferred embodiment, it is envisaged that the connecting member may comprise other shapes, such as square or rectangular. Furthermore, the apertures 24,25,26 may be arranged at 90 degrees to each other or may be arranged at some other angular spacing, such as 120 degrees. In an alternative embodiment the connecting member may comprise a simple metal or plastic ring, although such would not provide such a broad contact area with the back of the wearer's head and hence may not be as comfortable for the wearer.

What is claimed is:

1. A mask for protecting the face and neck of a wearer while fencing, the mask comprising a band of elastomeric material having a front edge and a rear edge;

a first mesh portion having a dome-shaped configuration and including a peripheral edge secured substantially along said front edge of said band of elastomeric material;

a second mesh portion having a front edge and a rear edge, said front edge of said second mesh portion secured substantially along said rear edge of said band of elastomeric material;

a neck covering portion secured to a lower portion of said second mesh portion; and a said retaining means comprising a first strap or harness member extending rearwardly and downwardly from an upper portion of the mask body, a second strap or harness member extending rearwardly from a first side of the mask body, a third strap or harness member extending rearwardly from a second side of the mask body opposite said first side, a connecting member being provided at the intersection of the first, second and third strap or harness members, each of said first, second and third strap or harness members being connected to said connecting member.

2. The mask of claim 1, wherein the first, second and third strap members are formed from an elastic material.

3. The mask of claim 1, wherein the connecting member comprises a substantially planar or dished plate-like member having first, second and third apertures therein, through which apertures are respectively received a respective end of the first, second and third strap members.

4. The mask of claim 3, wherein said apertures comprise elongate slots.

5. The mask of claim 3, wherein a distal end of the first strap member passes through a respective aperture in the connecting member, said distal end being folded back to lie against a portion of the first strap member, a securing means being provided on the first strap member to retain the distal end thereof against said portion of the first strap member.

6. The mask of claim 5, wherein the second and third strap members comprise separate strap members and are secured to the connecting member in the same manner as the first strap member.

7. The mask of claim 5, wherein the securing means of the first strap member comprises a hook and loop fastening means.

8. The mask of claim 7, wherein the securing means comprises an elasticated hook and loop fastening means.

9. The mask of claim 3, wherein the second and third strap member comprise portions of a single strap member extending from said first side of said mask body to said second side of said mask body and passing through the second and third apertures in the connecting member.

10. The mask as claimed in any of claims 3, wherein each of the second and third strap members comprise separate elongate members, a distal end of each passing through a respective aperture in the connecting member, and extending over said connecting member such that said distal ends overlap each other, securing means being provided on each of the second and third strap members to secure said distal ends of the respective strap member together while allowing the combined length of the second and third strap members to be adjusted.

11. The mask of claim 10, wherein the securing means of the second and third strap members comprises a hook and loop fastening means.

12. The mask of claim 11, wherein the securing means comprises an elasticated hook and loop fastening means.

13. The mask of claim 1, wherein the connecting member is shaped to conform to the approximate shape of the rear portion of the wearer's head whereupon the connecting member will rest during use of the mask.

* * * * *